US010879676B2

(12) United States Patent
Reinsch et al.

(10) Patent No.: US 10,879,676 B2
(45) Date of Patent: Dec. 29, 2020

(54) SPARK PLUG RESISTANCE ELEMENT COMPRISING FINE NON-CONDUCTIVE PARTICLES

(71) Applicant: Robert Bosch GmbH, Stuttgart (DE)

(72) Inventors: Benedikt Reinsch, Biederich (DE); Stefan Nufer, Stuttgart (DE); Hubertus Braun, Renningen (DE); Carsten Kuenzel, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/635,341

(22) PCT Filed: Sep. 19, 2018

(86) PCT No.: PCT/EP2018/075311
§ 371 (c)(1),
(2) Date: Jan. 30, 2020

(87) PCT Pub. No.: WO2019/063380
PCT Pub. Date: Apr. 4, 2019

(65) Prior Publication Data

US 2020/0161838 A1 May 21, 2020

(30) Foreign Application Priority Data

Sep. 28, 2017 (DE) ..... 10 2017 217 265

(51) Int. Cl.
*H01T 13/39* (2006.01)
*H01T 13/32* (2006.01)
(Continued)

(52) U.S. Cl.
CPC ..... *H01T 13/39* (2013.01); *H01T 13/32* (2013.01); *H01T 13/34* (2013.01); *H01T 21/02* (2013.01)

(58) Field of Classification Search
CPC ..... H01T 13/32; H01T 13/34; H01T 13/39; H01T 21/02
See application file for complete search history.

(56) References Cited

U.S. PATENT DOCUMENTS

2011/0133626 A1* 6/2011 Shibata ..... H01T 21/02 313/141
2011/0248620 A1* 10/2011 Shibata ..... H01C 17/0652 313/141
(Continued)

FOREIGN PATENT DOCUMENTS

DE 2 245 404 A1 3/1974
DE 100 16 416 A1 10/2001
(Continued)

OTHER PUBLICATIONS

International Search Report corresponding to PCT Application No. PCT/EP2018/075311, dated Oct. 30, 2018 (German and English language document) (5 pages).

*Primary Examiner* — Mariceli Santiago
(74) *Attorney, Agent, or Firm* — Maginot, Moore & Beck LLP

(57) ABSTRACT

A spark plug includes a housing, an isolator arranged in the housing, and a ground electrode arranged on a front surface of the housing on a combustion chamber side. The spark plug further includes a central electrode, a terminal stud, and a resistance element all of which are arranged in the isolator. The resistance element is spatially arranged between the central electrode and the terminal stud and connects the central electrode to the terminal stud. The ground electrode forms a spark gap together with the central electrode. The resistance element contains a resistance material that contains conductive particles and non-conductive particles. At least 80% of the non-conductive particles have a maximum diameter of 20 μm.

15 Claims, 3 Drawing Sheets

(51) Int. Cl.
*H01T 13/34* (2006.01)
*H01T 21/02* (2006.01)

(56) References Cited

U.S. PATENT DOCUMENTS

| | | | | |
|---|---|---|---|---|
| 2012/0126683 | A1* | 5/2012 | Yoshida | C03C 8/02 313/141 |
| 2012/0176021 | A1* | 7/2012 | Yoshida | C03C 8/02 313/141 |
| 2015/0325982 | A1* | 11/2015 | Takaoka | H01T 13/41 315/71 |
| 2016/0204579 | A1 | 7/2016 | Yoshida et al. | |

FOREIGN PATENT DOCUMENTS

| | | | | | |
|---|---|---|---|---|---|
| DE | 698 06 437 | T2 | | 11/2002 | |
| DE | 10 2009 047 055 | A1 | | 5/2011 | |
| DE | 10 2010 063 752 | A1 | | 6/2012 | |
| DE | 10 2016 200 430 | A1 | | 7/2017 | |
| EP | 0 874 432 | A2 | | 10/1998 | |
| JP | S61-253786 | A | | 11/1986 | |
| JP | 2017139209 | A | * | 8/2017 | |
| JP | 2018181595 | A | * | 11/2018 | H01M 2/1016 |

* cited by examiner

SPARK PLUG RESISTANCE ELEMENT COMPRISING FINE NON-CONDUCTIVE PARTICLES

This application is a 35 U.S.C. § 371 National Stage Application of PCT/EP2018/075311, filed on Sep. 19, 2018, which claims the benefit of priority to Serial No. DE 10 2017 217 265.7, filed on Sep. 28, 2017 in Germany, the disclosures of which are incorporated herein by reference in their entirety.

BACKGROUND

The disclosure is directed to a spark plug.

Presently spark plugs have a resistance element having a specific resistance in the range of 1 to 14 k for reducing the electrode wear and for avoiding electromagnetic interference (EMI) in the spark plug and in the internal combustion engine. The resistance element is typically arranged in the spark plug between the terminal stud and the center electrode inside the spark plug insulator. The resistance element is frequently a material mixture made of various conductive particles and nonconductive particles, for example, carbon, which has a carbon proportion of C>97 wt. %, or carbon black, which has a carbon proportion of up to 60 wt. %, $ZrO_2$, and borosilicate glass. The conductive particles have a diameter in the submillimeter range and are also referred to as fine particles because of the size thereof. The conductive particles form the conduction paths for the current through the resistance element. The nonconductive particles are substantially larger in the diameter thereof and are accordingly also referred to as coarse particles. The conduction paths for the current form due to the distribution of the nonconductive particles and the conductive particles in the resistance element. The width of the conduction paths influences the current density and thus also the specific electrical resistance in the resistance element. The specific electrical resistance for the resistance element results, inter alia, from the material composition and the material distribution.

As with all resistors, the resistance element also has a maximum amperage which can flow through the resistance element before a breakthrough of the current in the resistance element occurs, which destroys the resistance element. This maximum amperage is a measure of the electrical stability of the resistance element and is decisive for the service life of the spark plug.

SUMMARY

It is accordingly the object of the present disclosure to provide a spark plug of the type mentioned at the outset having an improved resistance element, which has a high electrical stability.

This object is achieved according to the disclosure in the spark plug, comprising a housing, an insulator arranged in the housing, a center electrode arranged in the insulator, a terminal stud arranged in the insulator, a resistance element arranged in the insulator, which is arranged spatially between the center electrode and the terminal stud and electrically connects the center electrode to the terminal stud, wherein the resistance element contains a resistance panat, wherein the resistance panat contains conductive particles and nonconductive particles, and a ground electrode arranged on an end face of the housing on the combustion chamber side, which ground electrode forms a spark gap together with the center electrode, in that at least 80% of the nonconductive particles have a diameter of at most 20 μm.

A larger surface-volume ratio thus results in the nonconductive particles, which ensures better coating of the nonconductive particles by the conductive particles in the material mixture of the resistance panat and thus enables more homogeneous distribution of conduction paths.

The conductive particles generally have a substantially smaller diameter than the nonconductive particles. The diameter of the conductive particles is typically less than 1 μm. The thickness of the conduction paths increases due to the reduced size of the nonconductive particles. This means that a substantially higher electrical amperage can flow through the resistance element before an electrical breakthrough of the electrical current in the resistance element occurs, which destroys the resistance element and thus also the spark plug. Experiments of the applicant have shown that the limit for the maximum amperage before the resistance element is destroyed by the excessively high amperage improves by a factor of 3 to 6.

Further advantageous designs are the subject matter of the dependent claims.

In one advantageous refinement of the disclosure, at least 90%, in particular 100%, of the nonconductive particles have a diameter of at most 20 μm. The higher the proportion is of the nonconductive particles which maintain the upper limit for the diameter, the better the above-described technical effect results. Alternatively or additionally, it is also conceivable to limit the upper limit for the diameter for the nonconductive particles to at most 10 μm or preferably even to at most 5 μm, so that the advantageous technical effect comes into effect even more strongly.

Particularly good embedding of the nonconductive particles in the conductive particles results if overall at least 80%, preferably even at least 90%, of the conductive particles and nonconductive particles have a diameter of at most 20 μm. This effect is also reinforced if the upper limit for the diameter of the conductive and nonconductive particles is at most 10 μm.

For example, the nonconductive particles are glass particles and/or ceramic particles. The nonconductive particles have, for example, an electrical conductivity of at most $10^{-2}$ S/m. The glass particles or ceramic particles can frequently be purchased from the producer having a corresponding diameter size. Alternatively or additionally, the nonconductive particles can be reduced by means of a wet grinding method to the desired diameter size.

In one preferred refinement of the disclosure, the glass particles contain an alkaline earth oxide, in particular CaO, and/or an alkali oxide, in particular $Li_2O$. For example, the glass particles are a borosilicate glass having $SiO_2$, $B_2O_3$, CaO, and $Li_2O$. The proportion of glass particles in the resistance panat is preferably less than or equal to 30 wt. %. The advantage results due to the relatively low glass particle proportion in the resistance panat that the conduction paths have a higher thickness, whereby the conduction paths in turn have a high current density.

Additionally or alternatively, the ceramic particles are $Al_2O_3$, $ZrO_2$, $TiO_2$. The conductive particles are preferably carbon, carbon black, graphite, copper, aluminum, or iron. It has proven to be advantageous if the conductive particles have a diameter of 300 nm to 1300 nm, in particular on average a diameter of 500 nm. In particular 50 vol. % of the conductive particles have a diameter of at least 300 nm.

In one refinement, the resistance element is a layer system which comprises the resistance panat and at least one contact panat. In this case, the at least one contact panat is spatially arranged between the terminal stud and the resistance panat or between the center electrode and the resistance panat, or if there are two contact panats, a first contact panat is spatially arranged between the terminal stud and the resistance panat and a second contact panat is spatially arranged between the resistance panat and the center electrode.

DETAILED DESCRIPTION

Figure 1:
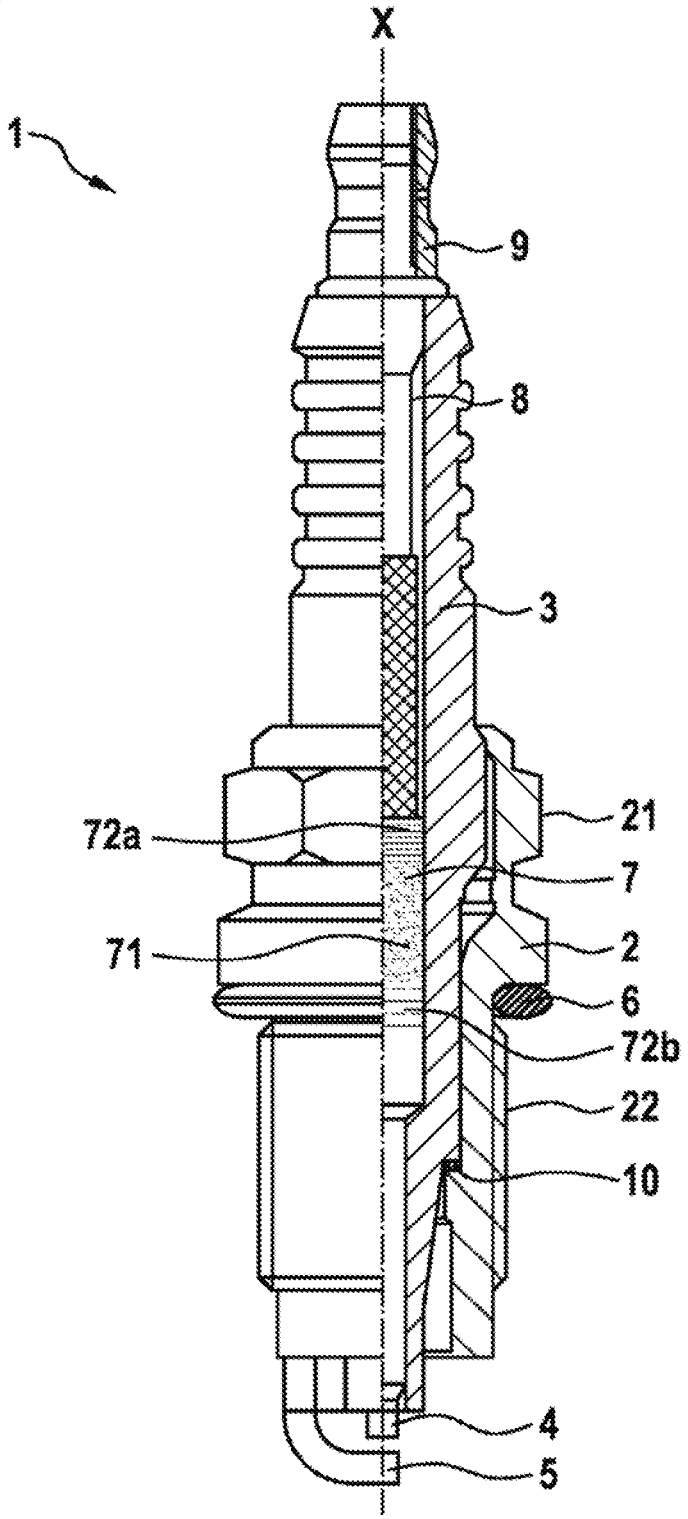
FIG. 1 shows an example of a spark plug.

FIG. 1 shows a spark plug 1 in a view in partial section. The spark plug 1 comprises a housing 2. An insulator 3 is inserted into the housing 2. The housing 2 and the insulator 3 each have a borehole along the longitudinal axis X thereof. The longitudinal axis of the housing 2, the longitudinal axis of the insulator 3, and the longitudinal axis of the spark plug 1 coincide. A center electrode 4 is inserted into the insulator 3. Furthermore, a terminal stud 8 extends in the insulator 3. A terminal nut 9 is arranged on the terminal stud 8, via which the spark plug 1 can be electrically contacted with a voltage source (not shown here). The terminal nut 9 forms the end of the spark plug 1 facing away from the combustion chamber.

A resistance element 7, also called panat, is located in the insulator 3 between the center electrode 4 and the terminal stud 8. The resistance element 7 electrically conductively connects the center electrode 4 to the terminal stud 8. The resistance element 7 is constructed, for example, as a layer system made of a first contact panat 72*a*, a resistance panat 71, and a second contact panat 72*b*. The layers of the resistance element 7 differ by way of the material composition thereof and the electrical resistance resulting therefrom. The first contact panat 72*a* and the second contact panat 72*b* can have different electrical resistances or equal electrical resistance. The resistance element 7 can also have only one layer of resistance panat or multiple different layers of resistance panat having different material compositions and resistances.

The insulator 3 rests with a shoulder on a housing seat formed on the housing inner side. To seal the air gap between housing inner side and insulator 3, an inner seal 10 is arranged between the insulator shoulder and the housing seat, which is plastically deformed upon the clamping of the insulator 3 in the housing 2 and thus seals the air gap.

A ground electrode 5 is arranged in an electrically conductive manner on the housing 2 on its end face on the combustion chamber side. The ground electrode 5 and the center electrode 4 are arranged in relation to one another such that a spark gap forms between them, at which the ignition spark is generated.

The housing 2 comprises a shaft. A polygon 21, a shrinkage recess, and a thread 22 are formed on this shaft. The thread 22 is used for screwing the spark plug 1 into an internal combustion engine. An outer seal element 6 is arranged between the thread 22 and the polygon 21. The outer seal element 6 is designed in this exemplary embodiment as a folded seal.

Figure 2:
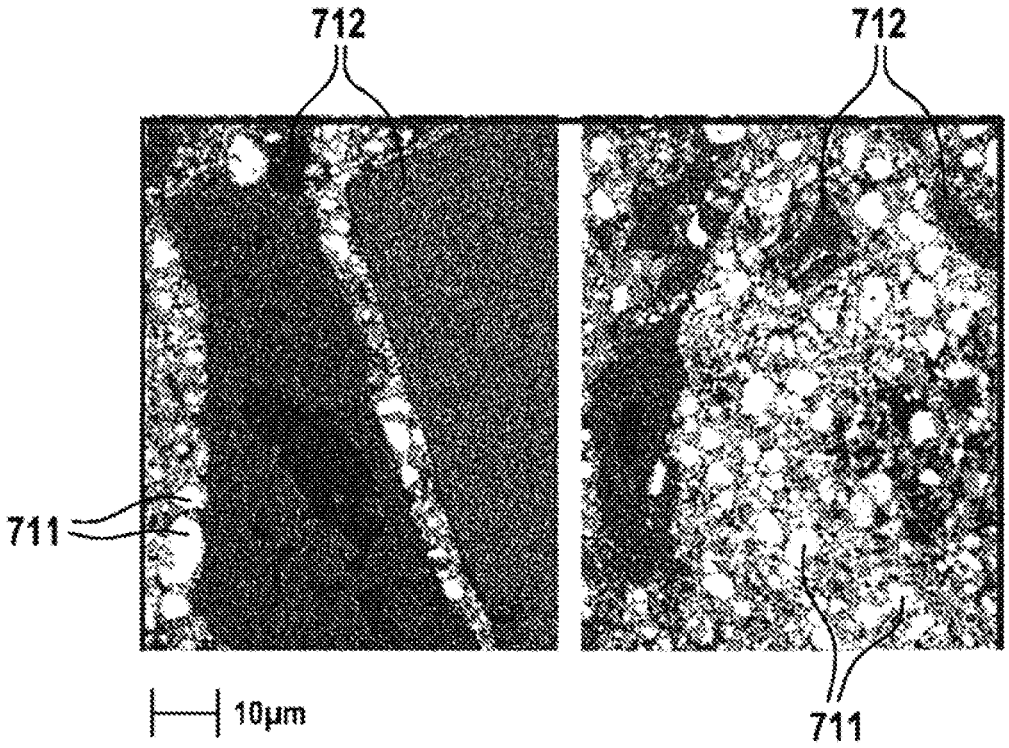
FIG. 2 shows SEM measurements in the comparison of a sample according to the prior art (right) and a sample according to the disclosure (left).

An SEM measurement (SEM=scanning electron microscope) of a sample according to the prior art (left image half) and a sample according to the disclosure (right image half) are shown in comparison in FIG. 2. The black regions are nonconductive particles 712 and the light regions 711 are conductive particles. The dark regions 712 primarily consist of the coarse nonconductive particles, such as glass particles or ceramic particles, for example, $Al_2O_3$. The light regions 711 are composed of fine conductive carbon particles (small black dots) and nonconductive $ZrO_2$ particles (light points). The $ZrO_2$ particles form agglomerates, which are visible as light points in the SEM image.

In the sample according to the prior art, the nonconductive particles 712 have a diameter of greater than 20 μm and the fine conductive particles 711 have a diameter of at most 10 μm. In contrast thereto, it can be seen in the measurement on the sample according to the disclosure that the nonconductive particles 712 are substantially smaller and have a diameter of at most 20 μm. The regions having the fine conductive particles 711 are distributed substantially more uniformly than in the sample according to the prior art.

Figure 3:
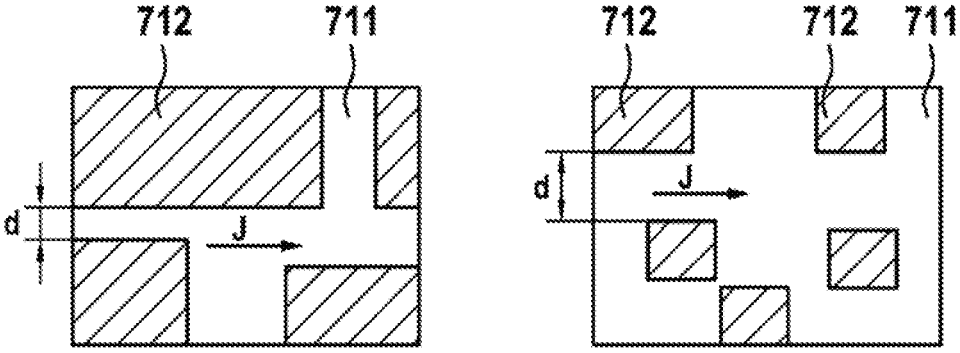
FIG. 3 shows a schematic illustration of the structure of the resistance panat of a sample according to the prior art (left) and a sample according to the disclosure (right) in comparison.

The structure of the material of the resistance panat for a sample according to the prior art (left image) and for a sample according to the disclosure (right image) is shown very schematically in FIG. 3. The images from FIG. 2 were the template for this schematic illustration. The dark regions 712 again represent the regions of the nonconductive particles and the light regions 711 stand for the conduction path regions, consisting of a mixture of fine conductive particles and fine nonconductive ceramic particles. Because the nonconductive particles 712 have a smaller diameter, they are distributed more uniformly in the resistance panat, so that a more homogeneous distribution of conduction path thicknesses results, in particular fewer very thin conduction paths, which have a comparatively high current density. The width d for a conduction path is furthermore limited by the adjoining regions of the nonconductive particles 712. The measurements of the applicant have shown that in a resistance panat 71 according to the disclosure, the conduction paths are substantially wider than in the resistance panat 71 according to the prior art. The width d of the conduction paths also directly influences the current density j, which flows through the resistance panat 71 and through the resistance element 7.

Figure 4:
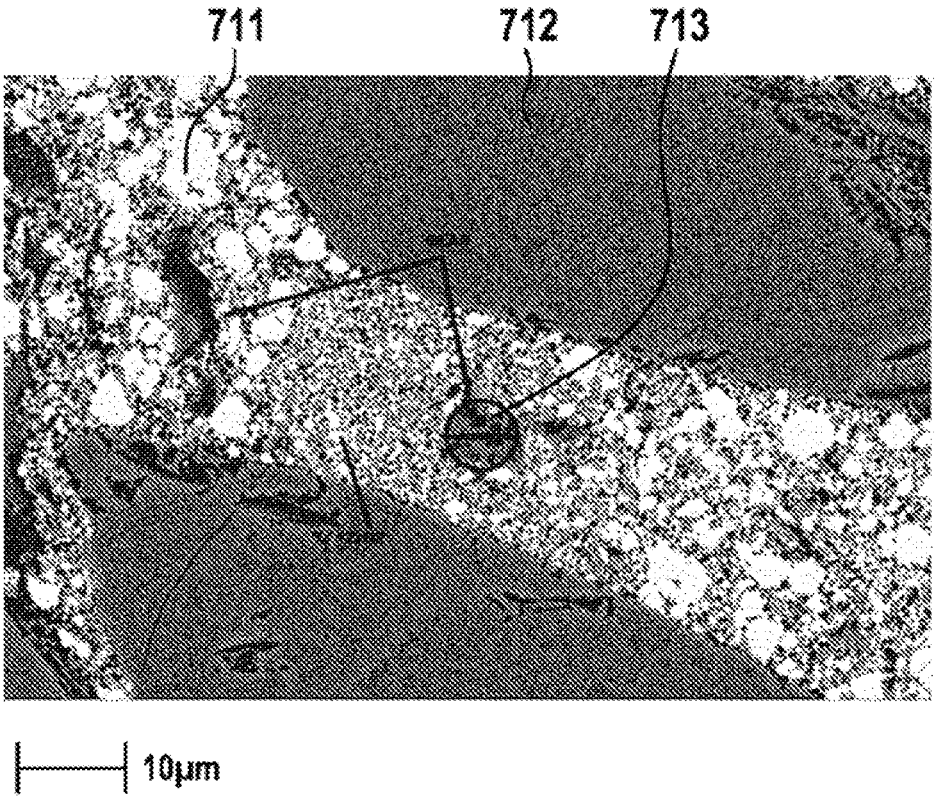
FIG. 4 shows a schematic illustration of an SEM image with light regions which form conduction paths and dark regions which primarily consist of coarse nonconductive particles.

FIG. 4 shows a schematic illustration of an SEM image. The light regions 711 form the conduction paths, which are composed of conductive carbon particles (small black dots) and nonconductive $ZrO_2$ particles (light spots). The $ZrO_2$ particles form agglomerates, which are visible as light spots in the SEM image. The dark regions 712 primarily consist of the coarse nonconductive particles, such as glass particles or ceramic particles, for example, $Al_2O_3$.

It is shown by way of example how the particle diameter is determined on the basis of a glass particles 713, which is located in the conduction path. A circle is placed in the SEM image around the particle to be measured, which has the same area as the particle. The diameter of the circle is then equivalent to the diameter of the particle.

The invention claimed is:

1. A spark plug, comprising:

a housing;

an insulator arranged in the housing;

a center electrode, a terminal stud, and a resistance element all of which are arranged in the insulator; and a ground electrode that is arranged on an end face of the housing on a combustion chamber side and forms a spark gap together with the center electrode, wherein:

the resistance element is spatially arranged between the center electrode and the terminal stud and electrically connects the center electrode to the terminal stud, the resistance element containing a resistance panat that contains at least one conduction path region including fine conductive particles and fine nonconductive particles, the at least one conduction path region extending through a plurality of coarse nonconductive particles, and at least 80% of the plurality of coarse nonconductive particles have a diameter of at most 20 μm.

2. The spark plug as claimed in claim 1, wherein at least 90% of the plurality of coarse nonconductive particles have a diameter of at most 10 μm.

3. The spark plug as claimed in claim 1, wherein at least 80% of the fine conductive particles and at least 80% of the plurality of coarse nonconductive particles have a diameter of at most 20 μm.

4. The spark plug as claimed in claim 1, wherein the plurality of coarse nonconductive particles are glass particles and ceramic particles.

5. The spark plug as claimed in claim 4, wherein the glass particles contain one or more of an alkaline earth oxide and an alkali oxide.

6. The spark plug as claimed in claim 4, wherein the proportion of the glass particles in the resistance panat is less than or equal to 30 wt. %.

7. The spark plug as claimed in claim 4, wherein the ceramic particles are one or more of $Al_2O_3$, $ZrO_2$, and $TiO_2$.

8. The spark plug as claimed in claim 1, wherein the fine conductive particles are carbon black, graphite, iron, copper, or aluminum.

9. The spark plug as claimed in claim 8, wherein the fine conductive particles have a diameter of 300 nm to 1300 nm.

10. The spark plug as claimed in claim 1, wherein the resistance element is a layer system, which comprises the resistance panat and at least one contact panat, wherein the at least one contact panat is arranged spatially between the terminal stud and the resistance panat or between the center electrode and the resistance panat, or wherein a first contact panat is arranged spatially between the terminal stud and the resistance panat and a second contact panat is arranged spatially between the resistance panat and the center electrode.

11. The spark plug as claimed in claim 5, wherein the alkaline earth oxide is CaO.

12. The spark plug as claimed in claim 5, wherein the alkali oxide is $Li_2O$.

13. The spark plug as claimed in claim 5, wherein the glass particles contain a borosilicate glass having $SiO_2$, $B_2O_3$, CaO, and $Li_2O$.

14. The spark plug as claimed in claim 1, wherein:

the fine conductive particles have a diameter of no more than 10 μm; and the fine nonconductive particles have a diameter of no more than 10 μm.

15. A spark plug, comprising:

a housing;

an insulator arranged in the housing;

a center electrode, a terminal stud, and a resistance element all of which are arranged in the insulator; and a ground electrode that is arranged on an end face of the housing on a combustion chamber side and forms a spark gap together with the center electrode, wherein:

the resistance element is spatially arranged between the center electrode and the terminal stud and electrically connects the center electrode to the terminal stud, the resistance element containing a resistance panat that contains conductive particles and nonconductive particles in the form of glass particles and ceramic particles, at least 80% of the nonconductive particles have a diameter of at most 20 μm, and the proportion of the glass particles in the resistance panat is less than or equal to 30 wt. %.

* * * * *